US010625134B1

(12) United States Patent
Dean

(10) Patent No.: US 10,625,134 B1
(45) Date of Patent: Apr. 21, 2020

(54) GOLF TRAINING DEVICE

(71) Applicant: Richard Dale Dean, Parsons, KS (US)

(72) Inventor: Richard Dale Dean, Parsons, KS (US)

( * ) Notice: Subject to any disclaimer, the term of this patent is extended or adjusted under 35 U.S.C. 154(b) by 0 days.

(21) Appl. No.: 16/266,547

(22) Filed: Feb. 4, 2019

(51) Int. Cl.
*A63B 69/36* (2006.01)

(52) U.S. Cl.
CPC ..... *A63B 69/3661* (2013.01); *A63B 69/3676* (2013.01)

(58) Field of Classification Search
CPC ..... A63B 69/3661; A63B 69/3676
USPC ..... 473/139, 143, 180, 185, 195, 422, 430, 473/435, 257, 258, 260, 261, 264
See application file for complete search history.

(56) References Cited

U.S. PATENT DOCUMENTS 4,303,245 A * 12/1981 Brockett ..... A63B 63/00 160/351
4,900,030 A * 2/1990 Houtz ..... A63B 69/3676 473/258
6,048,273 A * 4/2000 Clement ..... A63B 69/3676 273/DIG. 21
7,997,995 B2 * 8/2011 Willis ..... A63B 69/3676 473/257
2003/0224880 A1 * 12/2003 Hansberry ..... A63B 69/0002 473/430
2005/0192126 A1 * 9/2005 Remaklus ..... A63B 63/08 473/447
2016/0158618 A1 * 6/2016 Falzon ..... A63B 69/0002 473/430

* cited by examiner

*Primary Examiner* — Nini F Legesse
(74) *Attorney, Agent, or Firm* — Erickson Kernell IP, LLC; Mark C. Young

(57) ABSTRACT

A golf training device for practicing putting, chipping, or other golf shots includes a target suspended from a support frame. The diameter of the target simulates the diameter of a standard golf cup, and the height of the target above the surface is adjustable via one or more adjustment mechanisms so that the golf training device can be used on actual golf course surfaces. A lower base provides a containment area for golf balls hit into the device, a resilient cover on the lower base absorbs the impact of hit golf balls and directs them into the containment area. The device is easily repositioned via a carrying handle, and folds via hinge mechanisms to provide compact storage.

14 Claims, 5 Drawing Sheets

GOLF TRAINING DEVICE

BACKGROUND OF THE INVENTION

Various types of training devices are used by golf players and enthusiasts to improve aspects of their game. For example, devices and apparatus to teach and train specific swing techniques are ubiquitous and featured in magazines, infomercials, sporting goods stores, and pro shops. Likewise, specific driving devices and apparatus teach and train golfers' driving skills, with numerous putting training devices and equipment directed towards improving golfers' putting skills.

With respect to putting, because the end target in golf is a recessed hole or cup in the green, most putting training devices rely on an elevated cup to simulate the green, with a sloped ramp leading to the cup. A typical configuration for a putting practice device includes a roll-out mat, simulating a putting green surface, with a ramp and cup at one end so that a player will arrange the mat on a surface and putt golf balls toward the cup. Because the roll-out mat does not accurately simulate a putting green surface, and because the ramp and cup arrangement does not accurately simulate an actual cup positioned flush with the green surface, most putting practice devices are considered to be novelty items rather than actual training devices.

While providing some amusement value, the lack of accurate representation of actual conditions encountered in golfing renders them value for putting or chipping practice and training.

Thus, it can be seen that there is a need in the art for a golf training device that provides accurate representation of golf course cup layout and conditions, and that is easily and conveniently usable by golfers to practice and improve their game.

SUMMARY OF THE INVENTION

Embodiments of the invention are defined by the claims below, not this summary. A high-level overview of various aspects of the invention is provided here to introduce a selection of concepts that are further described in the Detailed Description section below. This summary is not intended to identify key features or essential features of the claimed subject matter, nor is it intended to be used in isolation to determine the scope of the claimed subject matter. In brief, this disclosure describes, among other things, a golf training device.

The present invention is directed to a golf training device for practicing putting or chipping, comprising a target suspended from a support frame, that allows practice on actual golf course surfaces with the target providing an accurate representation of a recessed cup.

In an exemplary embodiment, the training device includes a wide, inverted "U"-shaped upper support bar, with a cylindrical target suspended from a cord attached at opposite ends to first and second adjustment mechanisms on the upper support bar such that the cord forms a general "V" shape, with the target suspended at the lower point of the "V" and each upper end of each leg of the "V" attached to a corresponding adjustment mechanism.

A wide, "U" shaped lower base is attached via hinges to the lower ends of the legs of the upper support bar, so that the lowerbase can be folded between a closed position, in which the upper support bar and lower base lie parallel in close proximity for storage or shipping, and an open position, in which the lowerbase extends outwardly perpendicular to the upper support bar such that the upper support bar is supported in a vertical position, with the cylindrical target hanging therefrom.

With the device in the open position and the target suspended from the upper support bar, the adjustment mechanisms allow the height of the target above the surface to be adjusted as desired by lengthening or shortening the cord length below the support bar. Preferably, the target is adjusted so that the lower surface of the target lightly brushes the ground surface on which the device is sitting to provide some frictional contact between the target and the ground surface. The "V" shaped hanging configuration of the cord minimizes side-to-side oscillation of the target once struck, permitting it to return to its original starting location. Likewise, the frictional contact between the lower surface of the target and the ground surface on which the target is placed minimizes the swinging of the target once struck, allowing the target to quickly return to its starting suspended position.

Thus suspended, a golfer may place the device on an actual golf course surface, such as a green or fairway, and chip or putt golf balls towards the target to practice and improve his or her swing. A golf ball hitting the target indicates a ball that would have likely fallen into the cup on an actual golf course, with the mass and movement of the target absorbing momentum from the golf ball.

The "U" shaped lower base further acts as a containment area to corral golf balls that miss the target, as well as those that glance off of the target. In one embodiment, a resilient corrugated covering on the lower base absorbs the impact of received golf balls and prevents them from rebounding out of the containment area.

A handle positioned on the center of the upper support bar allows the device to be carried when in the folded and stored position, or to be lifted when in the unfolded position, and easily repositioned on the practice surface. When thus moved, the contained golf balls previously hit remain on the surface, and the golfer can then simply hit those balls back towards the repositioned training device without needing to stoop to retrieve or pick up any of the golf balls. The invention thus allows a user to achieve a high-throughput of practice hits in a minimal amount of time as the contained golf balls are immediately available for re-hitting without the user needing to stoop or otherwise move the golf balls captured by the device.

The device may thus be used for short or long-distance stroke practice, such as putting or chipping, and may be used on any indoor or outdoor surface, with the target height adjustable by a user to accommodate any surface. Because the device may be used on any surface, a user may place the device on an actual golf course surface, such as a green, fairway, or fringe of the green to allow realistic practice of strokes.

In other exemplary embodiments, the adjustment mechanisms may provide different levels of adjustment, such as fine or coarse adjustments, and in further embodiments the cord may be attached at one end to the upper support bar, with a single adjustment mechanism providing height adjustment.

DETAILED DESCRIPTION OF EXEMPLARY EMBODIMENTS

Various embodiments of the present invention are disclosed herein, it is to be understood that the disclosed embodiments are merely exemplary of the invention, which may be embodied in various forms. Thus, any specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology used in the following description is for convenience in reference only and is not limiting. For example, the words "vertically", "horizontally", "vertical", "horizontal" and "upwardly", "downwardly", "upper", "lower" all refer to the installed position of the item to which the reference is made. The words "inwardly" and "outwardly" refer to directions toward and away from, respectively, the geometric center of the embodiment being designated and parts thereof. The terminology used herein may include the words specifically mentioned, derivatives thereof and words of a similar import. It is further understood that terminology such as the aforementioned directional phrases may be used to describe exemplary embodiments of the golf training device as shown in the figures herein, such as a vertical positioning of the upper support bar of the device. This is for convenience only as it is understood that the exemplary embodiments of the golf training device described may be of varying size and shape, and that the upper support bar and device may be positioned at angles other than specifically horizontal or vertical.

Figure 1:
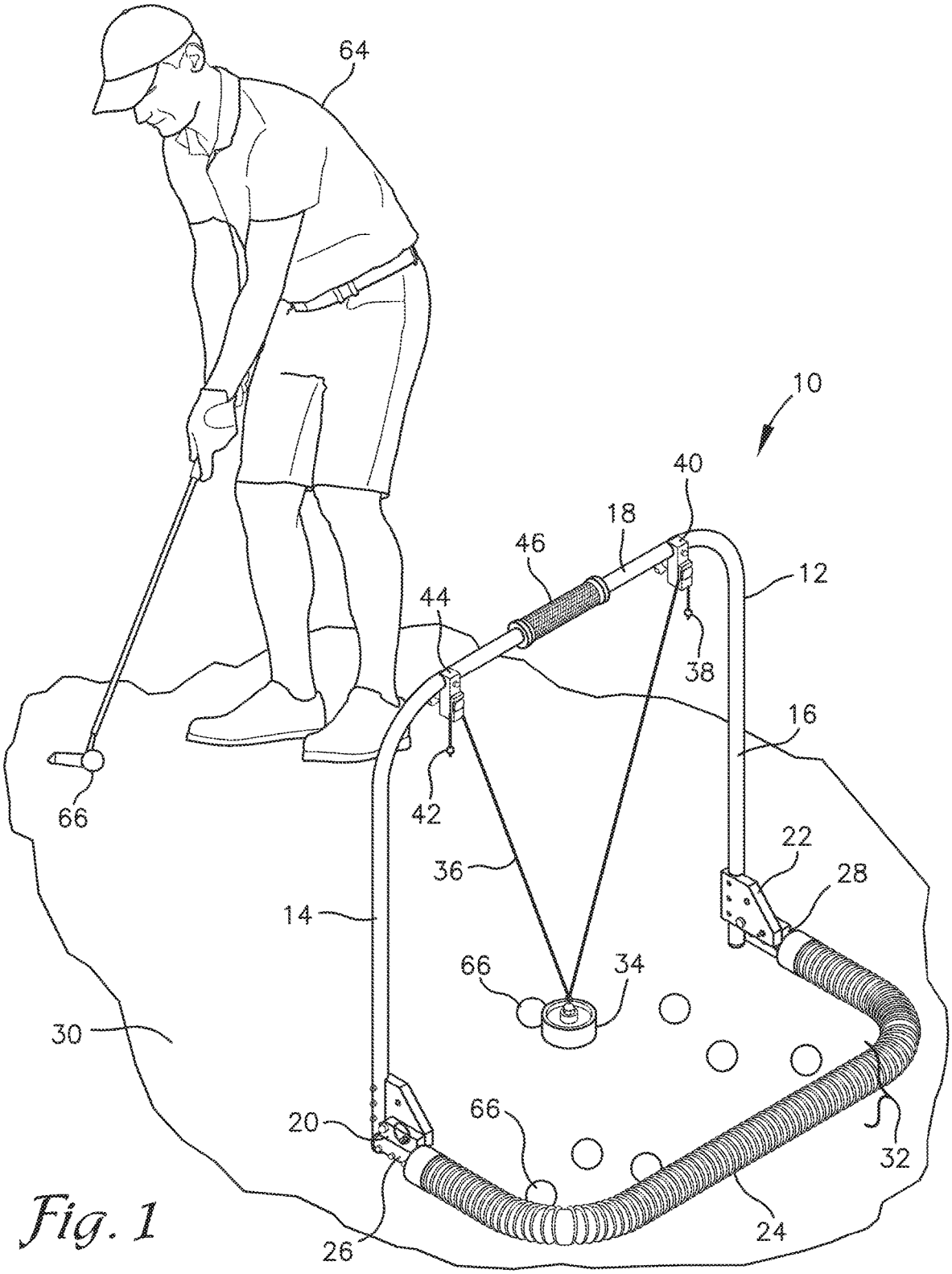
FIG. 1 is a perspective view of a golf training device in accordance with a first exemplary embodiment of the present invention shown in use on a surface.

Looking first to FIG. 1, a golf training device in accordance with an exemplary embodiment of the present invention is referenced generally by the numeral 10. The golf training device 10 comprises a wide, inverted "U"-shaped upper support bar 12 with first and second legs 14, 16 extending downwardly from a cross bar 18. The upper ends of legs 14, 16 converge into the corresponding ends of the cross bar 18, forming the integral curved upper support bar 12.

The upper support bar 12 is preferably formed of cylindrical tubing, and manufactured from a strong, stiff material, such as metal or steel. Most preferably, the upper support bar is coated or painted. In alternative embodiments, the upper support bar may be made from aluminum, plastic or composite materials. In further embodiments, the upper support bar may be formed from individual elements, such as separate legs and cross bar pieces joined together via friction fit insertion to each other, or via fasteners. These and other embodiments are within the scope of the present invention.

The lower ends of legs 14, 16 attach to corresponding hinge mechanism 20, 22, with the lower end of each leg attached to the hinge mechanism via fasteners or screws. A wide, "U"-shaped lower base 24 comprises first and second legs 26, 28 which attach at their distal ends to the corresponding hinge mechanism 20, 22 via fasteners or screws. As seen in FIG. 1, with the upper support bar 12 and lower base 24 attached to the hinge mechanism 20, 22, and with the hinges in their unfolded positions, the lowerbase 24 extends rearwardly and perpendicularly from the upper support bar 12 such that the lower base 24 acts as a stand to support the golf training device 10, with the upper support bar 12 positioned generally vertically to the surface 30 on which it is sitting.

A resilient corrugated covering 32 extends along substantially the entire length of lower base 24 to provide a low-rebound surface. The corrugated covering 32 is preferably a tube formed of a flexible, resilient material that slips over and around the lower base 24 to envelope and cover it, with the distal ends of the first and second legs 26, 28 extending therefrom to attach to the corresponding hinge mechanism 20, 22.

The lowerbase 24 is preferably formed of cylindrical tubing, and manufactured from a strong, stiff material, such as metal or steel. Most preferably, the lower base 24 is coated or painted. In alternative embodiments, the lower base may be made from aluminum, plastic or composite materials. In further embodiments, the lowerbase may be formed from individual elements, such as separate legs and cross bar pieces joined together via friction fit insertion to each other, or via fasteners. These and other embodiments are within the scope of the present invention.

A cylindrical target 34 is suspended from a cord 36, which is attached at a first end 38 to a first adjustment mechanism 40 attached to one side of the crossbar 18 of the upper support bar 12, and is attached at a second end 42 to a second adjustment mechanism 44 attached to an opposite side of the crossbar 18, such that the target 34 is suspended from the upper support bar 12 by the cord 36.

The cylindrical target 34 is thus suspended from the cord 36 such that the cord forms a general "V" shape, with the target suspended at the lower point of the "V" and each upper end of each leg of the "V" attached to a corresponding adjustment mechanism.

The "V" shaped hanging configuration of the cord minimizes side-to-side oscillation of the target once struck, permitting it to return to its original starting location. Likewise, the frictional contact between the lower surface of the target and the ground surface on which the target is placed minimizes the swinging of the target once struck, allowing the target to quickly return to its starting suspended position.

Target 30 is preferably cylindrical in shape, and manufactured from a semi-resilient material, such as plastic or nylon. Most preferably an eyebolt or other aperture is positioned on the upper surface of the target 30, or extending upwardly from the upper surface, configured to receive the cord 36 to allow the target 30 to be suspended.

Most preferably, the diameter of the cylindrical target 34 is approximately 2.6 inches, corresponding closely to the diameter of a standard golf cup (4.25 inches) minus the diameter of a standard golf ball (1.68 inches). The target thus simulates a standard golf cup in that a golf ball striking the target would be within a half a golf ball's distance over the edge of a standard cup, and thus the ball would ostensibly fall into the cup. In alternative embodiments described below, a target having a smaller diameter may be employed to further hone a golfer's skill in hitting close to the target.

A handle 46 is positioned in the center of cross bar 18 of upper support bar 12 to allow a user to lift and reposition the golf training device 10 as desired. Handle 46 is preferably a cushioned wrap that extends around the entire diameter of the cross bar 18.

Figure 2:
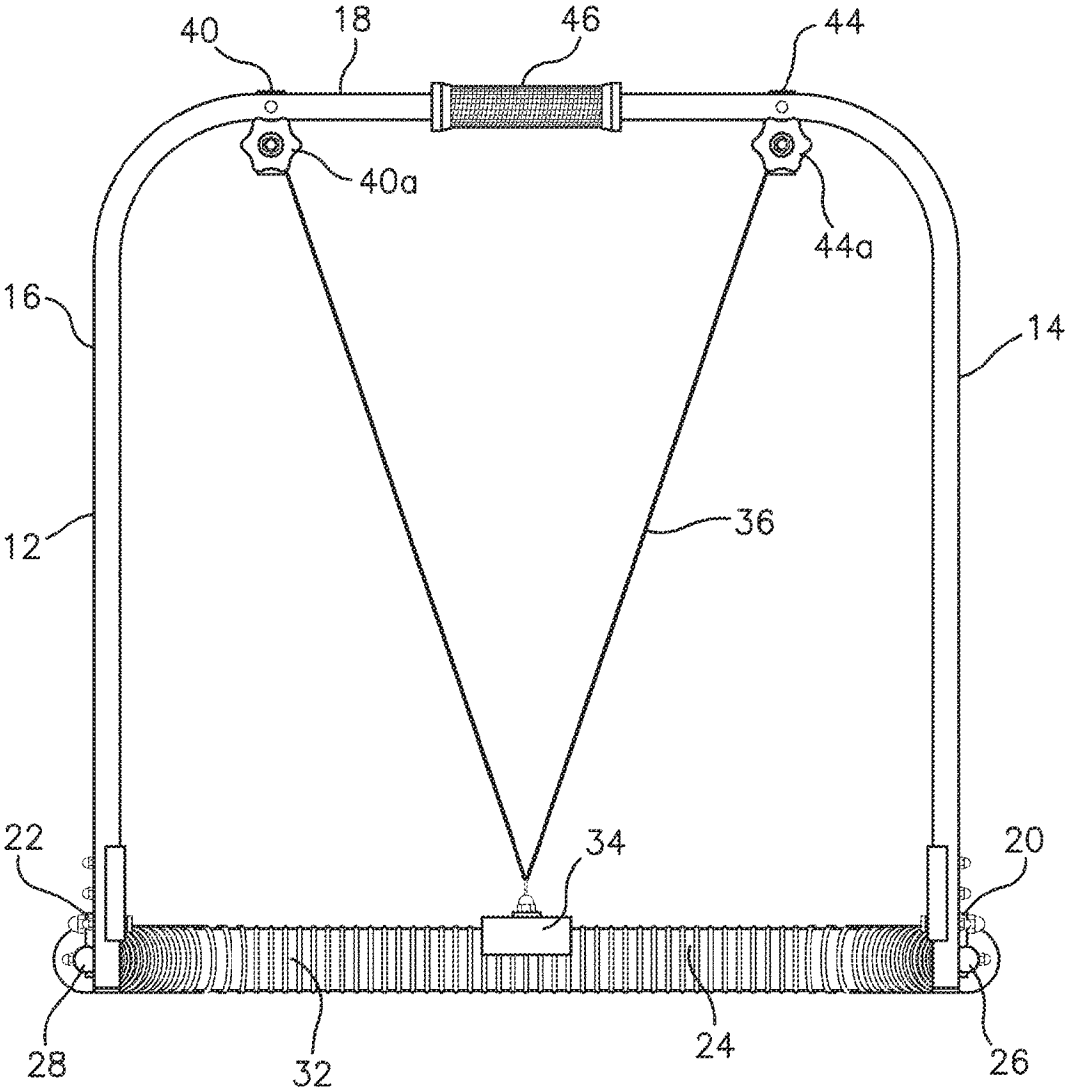
FIG. 2 is a front view of the golf training device of FIG. 1.

Looking to FIG. 2, a front view of the golf training device 10 of FIG. 1 shows the target 34 suspended via cord 36, from first and second adjustment mechanisms 40, 44 attached to the cross bar 18 portion of upper support bar 12. Adjustment knobs 40*a*, 44*a* corresponding to the adjustment mechanisms 40, 44 allow the cord 36 to be pulled or released to adjust the height of the target 4 above the surface.

The ends of legs 26, 28 of lower base 24 and the ends of legs 14, 16 of the upper support bar 12 are attached to the corresponding hinge mechanisms 20, 22 to join the upper support bar 12 and lower base 24 as previously described.

Figure 3:
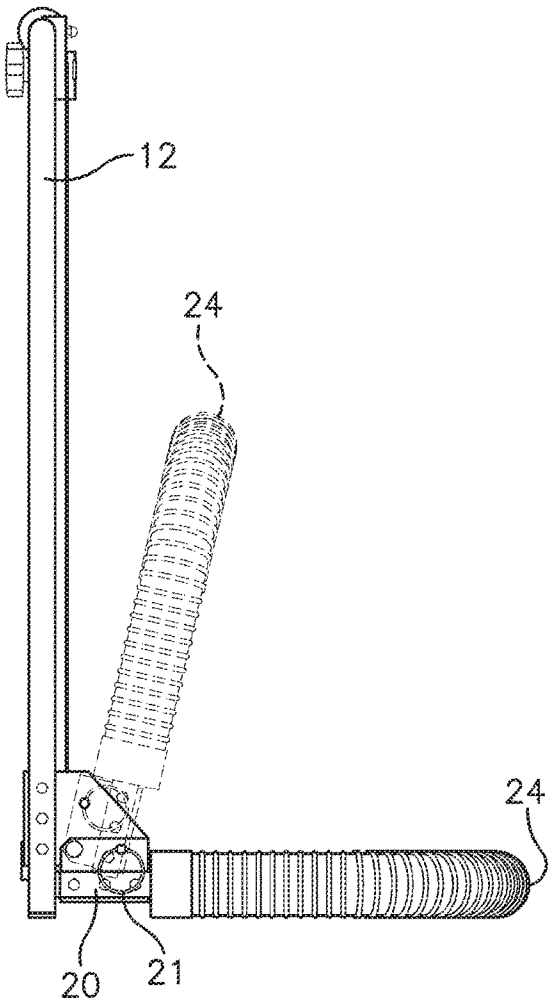
FIG. 3 is a side view of the golf training device of FIG. 1 showing the folding lower base.

As seen in FIG. 3, the hinge mechanism 20, 22 allow the lower base 24 to be pivoted between an open position in which the lower base 24 is perpendicular to the upper support bar 12 (i.e., a usable position), and a closed position in which the lower base 24 is in proximity and nearly parallel to the upper support bar 12 (i.e., a storage position). As also seen in FIG. 3, a locking pin with a pull ring 21 is used to secure the hinge mechanism 20 into the desired position by inserting through aligned apertures in the hinge mechanism. In alternative embodiments, other types of hinges and locking mechanisms may be used, such as spring locks and the like.

Figure 4:
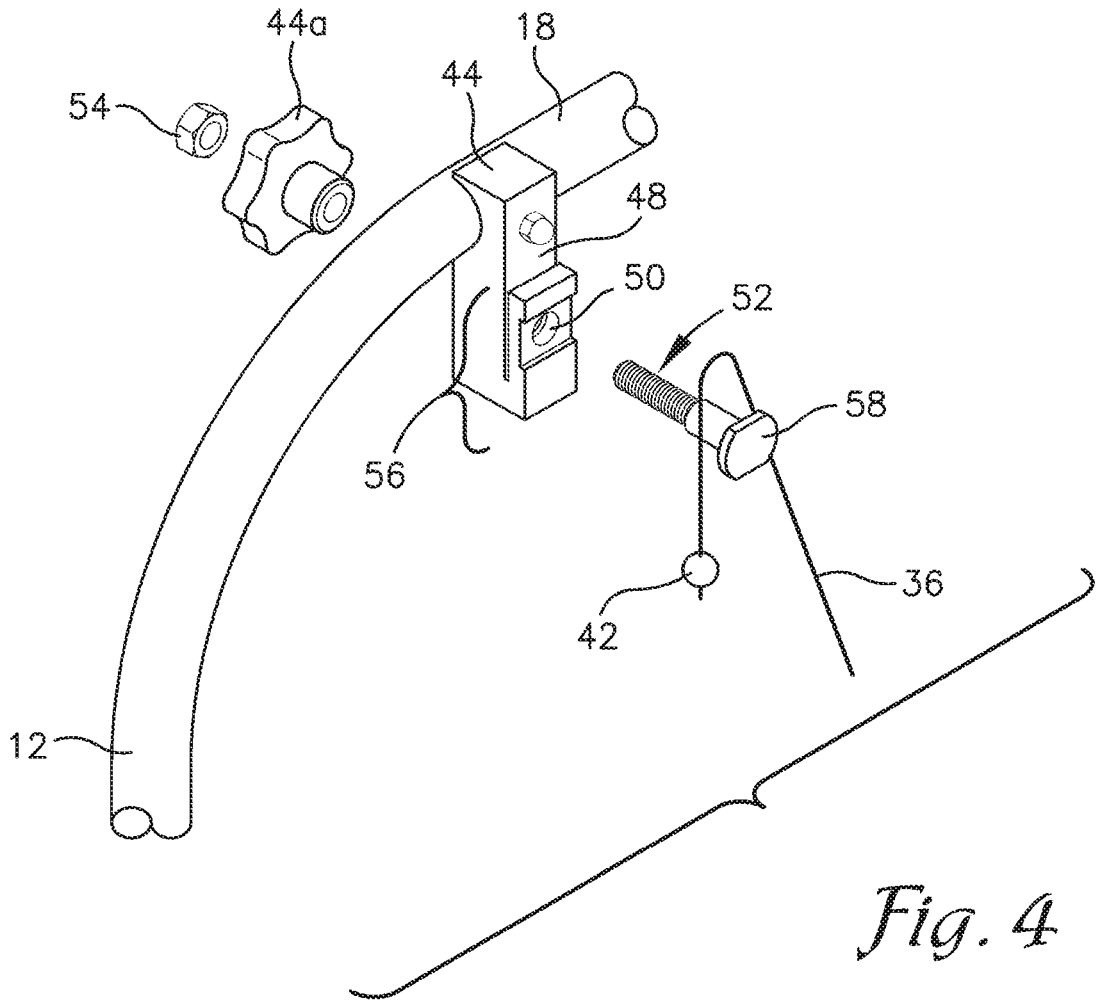
FIG. 4 is a fragmentary, close-up perspective view of an adjustment mechanism of the golf training device of FIG. 1.

Looking to FIG. 4, a close-up partial view of the adjustment mechanism 42 is depicted. As described previously, adjustment mechanism 44 is attached to cross bar 18 of upper support bar 12. The adjustment mechanism 44 comprises a rectangular body portion 48, having an aperture 50 formed therethrough to receive a shoulder bolt 52. The shaft of shoulder bolt 52 passes through the aperture 50 and threads into a nut 54 captured within adjustment knob 44*a*. A slot 56 formed in the body portion 48 surrounding the aperture 50 receives the flat head 58 of the shoulder bolt 52 such that the bolt cannot rotate when adjustment knob 44*a* is used to secure the shoulder bolt 52.

As shown in FIG. 4, the cord 36 passes over the smooth, unthreaded portion of the shoulder bolt 52, with the end 42 of the cord hanging downwardly therefrom.

With the cord 36 passing over the smooth portion of the shoulder bolt 52, it can be seen that the cord 56 may be adjusted by loosening the adjustment knob 44*a*, and pulling or releasing the end 42 of the cord 36 to position the target at a desired height above the surface, then tightening the adjustment knob 44*a* to secure the cord 36 behind the flat head 58 of the shoulder bolt 52. It should be apparent that the trapped shoulder bolt arrangement permits the adjustment knob 44*a* to be tightened without winding the cord 36, thus the cord and target are maintained at the desired positions while the knob 44 a is turned.

In alternative embodiments, other configurations of adjustment mechanisms may be used. For example, a guitar string tuning mechanism that winds and unwinds the cord may be used. In further embodiments, one of the adjustment mechanisms may be configured to fine tune the cord (and target height) position, with one adjustment mechanism providing coarse adjustment.

Figure 5:
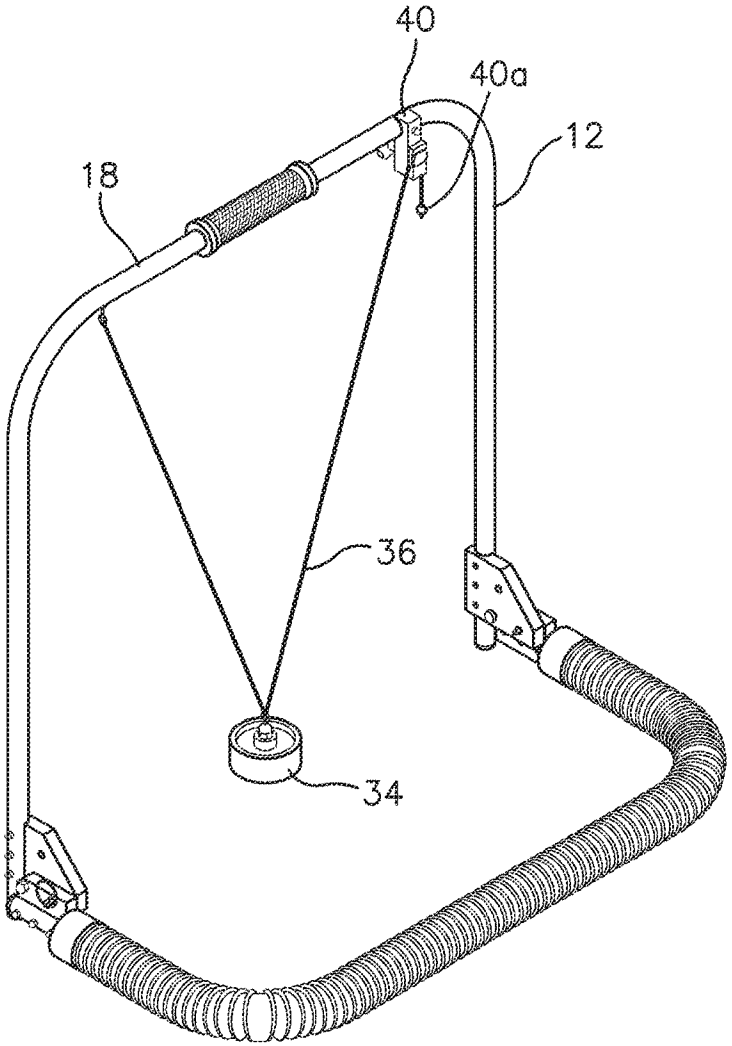
FIG. 5 is a perspective view of a golf training device in accordance with a second exemplary embodiment of the present invention having a single adjustment mechanism.

In further alternative embodiments, as seen in FIG. 5, a single adjustment mechanism 40 may be used, with the non-adjustable end of the cord 36 attached or affixed to the cross bar 18, or to an eyebolt, hook, or other attachment point attached thereto.

In alternative embodiments a cross bar or support bar may be attached to or between the upright legs 14, 16 using clamping devices or fasteners. The cross bar may be configured to support auxiliary devices, such as a laser indicator for providing a visible tracking line to a user of the device indicating a preferred target path for hitting the ball. Other devices, such as levels, may likewise be attached to the crossbar to provide additional features to the user.

Figure 6:
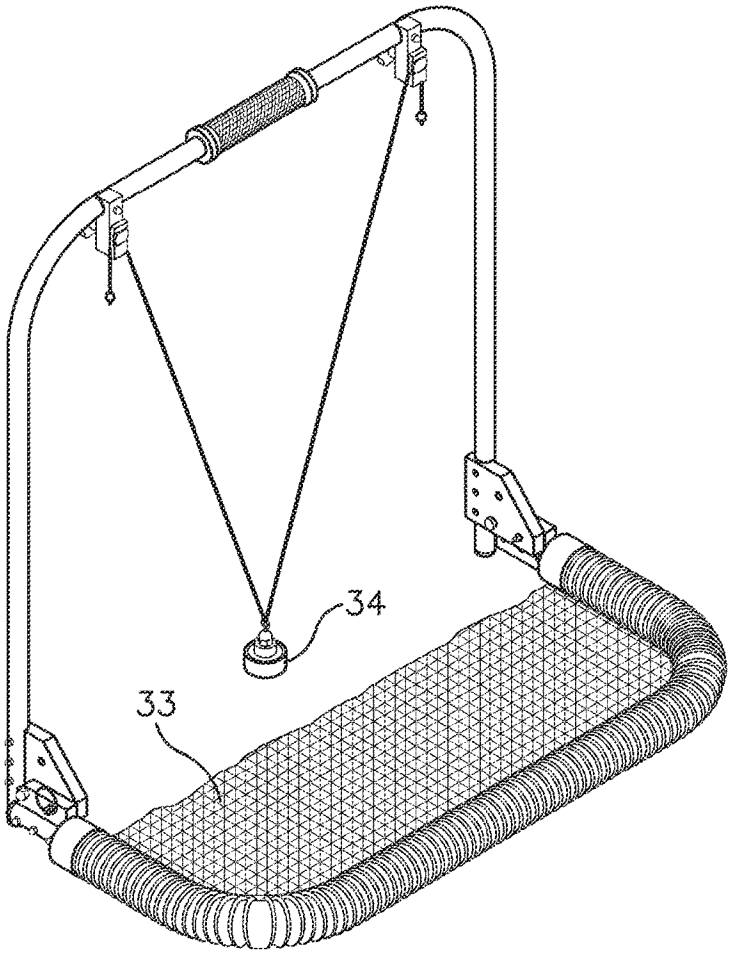
FIG. 6 is a perspective view of a golf training device in accordance with a third exemplary embodiment of the present invention having a smaller-sized target.

In another alternative embodiment as shown in FIG. 6, the diameter of target 34 is reduced to provide a smaller and harder-to-hit target, thus further improving and honing the accuracy of a golfer practicing using the training device. As also seen in FIG. 6, in other alternative embodiments, a netting 33 is attached along the bottom of the corrugated covering 32 so that the netting lies substantially flat across the surface on which the device is placed. In this alternative embodiment, hit golf balls collect on top of the netting 33, allowing a user to pick up the device with the trapped golf balls to move them to a different location, or to dump them into a bucket or golf bag.

Figure 8:
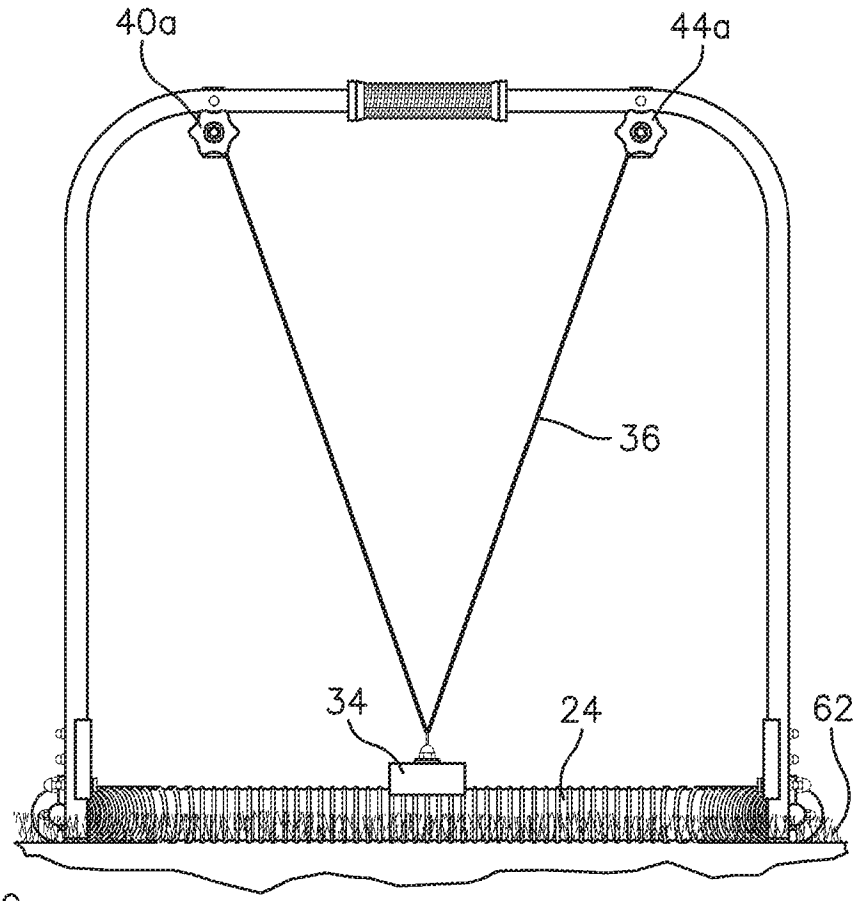
FIG. 8 is a front view of the golf training device of FIG. 1, shown in use on a tall-height golf fairway surface.
Figure 7:
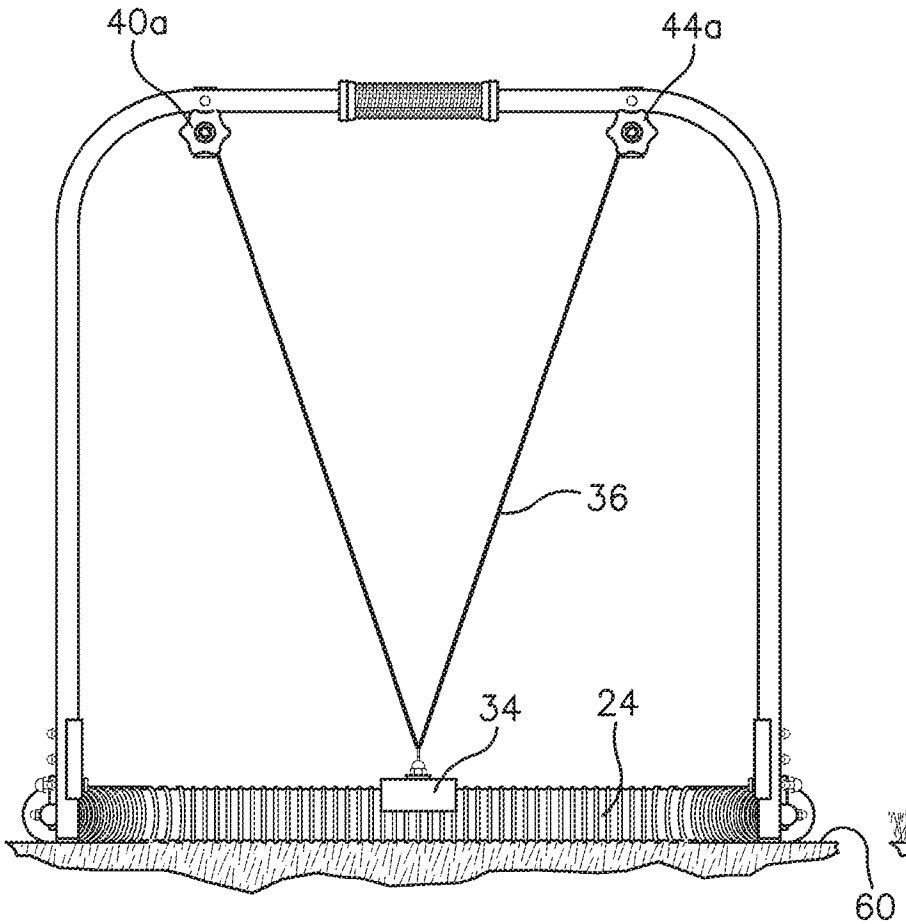
FIG. 7 is a front view of the golf training device of FIG. 1, shown in use on a short-height golf green surface.

With the adjustment mechanisms 40, 44 as just described, turning to FIGS. 7 and 8 it can be seen that the height of target 34 can thus be adjusted for use of the golf training device of the present invention on various surfaces. As seen in FIG. 7, when used on a short turf surface 60, such as a putting green, the height of the target 34 above the turf surface 60 can be adjusted using the adjustment knobs 40*a*, 44*a* to adjust the cord 36 in the manner described previously. Similarly, as shown in FIG. 8, when used with a longer turf surface 62, the height of the target 34 can likewise be adjusted such that it is a desired height above the turf 62. Comparing the heights of target 34 in FIGS. 7 and 8, it can be seen that while the actual height of the target 34 varies with respect to the lower base 24, the relative height of the target 34 above the respective turf surface 60, 62 is maintained.

Thus, the target height is adjustable as desired to account for varying ground and turf surfaces with which the golf training device is used. In use, it is preferably that the target 34 be adjusted so that the bottom surface of the target barely touches the surface or grass growing from the surface so that swing of the target is minimized.

With the structure and features of the golf training device set forth, an exemplary use of the device will now be described with reference back to FIG. 1.

Turning to FIG. 1, with the golf training device 10 as just described set in place on a surface 30, the height of target 34 is adjusted to a desired height above the surface 30 using the adjustment mechanisms 40, 44 to adjust the position of cord 36. The lower base 24 stabilizes the device 10 in place so that the target 34 remains positioned in the desired location. Hinge mechanisms 20, 22 position and secure the lower base 24 generally perpendicular to the upper support bar 12.

A golfer 64 hits golf balls 66 towards the target 34 to practice and improve his or her swing. Because the diameter of the target 34 is configured to simulate the diameter of a standard golf cup as discussed above, any golf ball 66 hitting the target 34 presumably would have fallen into an actual golf cup. Upon impact of a golf ball 66 with the target 34, momentum from the golf ball is transferred to the target, causing the target to swing, and allowing the golf ball to roll gently into the area defined within the confines of the lower base 24, between legs 26, 28. Similarly, golf balls 66 that do not hit the target rebound against corrugated resilient covering 32, which absorbs momentum from the golf ball, causing it to gently rebound into the area defined within the confines of lower base 24. As shown in FIG. 1, a plurality of hit golf balls 66 thus collect in the area defined by lower base 24 as the golfer 64 continues to hit practice shots.

Upon hitting his or her last practice shot, the user may easily set up for more practice by simply picking up the entire golf training device 10 by lifting it using handle 46, and carrying the device to a new location, such as back to the location where he or she had been hitting from. Then, the golf balls 66 collected where the device had previously been placed may be easily hit back to the new location of the device, without the user needing to pick up or otherwise retrieve the golf balls.

It should be understood that while the depiction of the device in FIG. 1 is used in conjunction with putting practice, that the device may likewise be used in conjunction with chipping practice, with the target acting as an accurate representation of the cup and the lower base corralling the hit balls into a confined location.

It should be further understood that the golf training device of the present invention may be used on actual golfing surfaces, such as an actual green or fringe surrounding a green, or on the fairway. As illustrated in FIGS. 7 and 8 and described above, the height of the target 34 is adjustable to conform to any surface with which the device is used.

The device may thus be used for short or long-distance stroke practice, such as putting or chipping, and may be used on any indoor or outdoor surface, with the target height adjustable by a user to accommodate any surface. Because the device may be used on any surface, a user may place the device on an actual golf course surface, such as a green, fairway, or fringe of the green to allow realistic practice of strokes.

Thus, it can be seen that the golf training device of the present invention overcomes the limitations of training devices known in the art, and is well adapted to provide practice of golf swings and shots. The device provides a simulated cup target without requiring a ramp as with devices known in the art, and can be used on actual golfing surfaces, such as greens and fairways so that the surface conditions while practicing with the device are identical to the actual conditions on the course.

It should be understood that while certain forms and embodiments have been illustrated and described herein, the present invention is not to be limited to the specific forms or arrangement of parts described and shown, and that the various features described may be combined in ways other than those specifically described without departing from the scope of the present invention. The terms "substantially", "generally", "approximately", or any other qualifying term as used herein may be applied to modify any quantitative representation which could permissibly vary without resulting in a change to the basic function to which it is related.

What is claimed is:

1. A golf training device, comprising:

a "U"-shaped lower base defining a containment space within the "U" shape;

a resilient corrugated cover attached to the lower base;

a netting attached to the resilient corrugated cover and extending along the lower edge of the base and defined containment space;

an upper support bar extending upwardly from the lower base;

a target suspended from the upper support bar; and an adjustment mechanism configured to allow adjustment of the height of the target above a surface; wherein the resilient corrugated cover and is configured to absorb impact from golf balls hit toward the device to prevent the balls from rebounding out of the containment space, and wherein the netting allows contained golf balls to be lifted by a user lifting the entire device.

2. The golf training device of claim 1, further comprising first and second hinges attached between the lower base and upper support bar such that the upper support bar is pivotable between an open position in which the upper support bar extends upwardly generally perpendicular to the lower base, and a closed position in which the upper support bar is generally parallel to and in proximity to the lower base.

3. The golf training device of claim 1, further comprising a cord attached between the target and the adjustment mechanism.

4. The golf training device of claim 1, wherein the target is cylindrical in shape and has a diameter of approximately two inches to three inches.

5. The golf training device of claim 4, wherein the target has a diameter of approximately 2.6 inches.

6. A golf training device, comprising:

a lower base;

a resilient corrugated cover attached to the lower base;

a netting attached to the resilient corrugated cover and extending along a containment space defined by the lower base;

an upper support bar attached to the lower base in generally perpendicular relationship; and a target suspended from the upper support bar; wherein the resilient corrugated cover and is configured to absorb impact from golf balls hit toward the device to prevent the balls from rebounding out of the containment space, and wherein the netting allows contained golf balls to be lifted by a user lifting the entire device.

7. The golf training device of claim 6, wherein the upper support bar is attached to the lower base by a hinge mechanism permitting the upper support bar to be pivoted with respect to the lower base.

8. The golf training device of claim 6, further comprising at least one adjustment mechanism attached to the upper support bar and operable to allow adjustment of a height of the target.

9. The golf training device of claim 8, further comprising a cord attached between the adjustment mechanism and the target.

10. The golf training device of claim 7, wherein the target has a diameter of approximately 2.6 inches.

11. A golf training device, comprising:

a "U"-shaped lower base defining a containment space within the "U" shape;

a "U"-shaped upper support bar extending upwardly from the lower base;

a resilient corrugated cover attached to the lower base;

a netting attached to the resilient corrugated cover and extending along the lower edge of the base and defined containment space;

first and second adjustment mechanisms attached to the upper support bar;

a cord extending between the first and second adjustment mechanisms; and a target suspended from the cord, wherein the adjustment mechanisms allow adjustment of a height of the target above a surface; wherein the corrugated cover and is operable to absorb impact from golf balls hit toward the device, or deflected off of the target, to prevent the balls from rebounding out of the containment space, and wherein the netting allows contained golf balls to be lifted in unison by a user lifting the entire device.

12. The golf training device of claim 11, further comprising first and second hinges attached between the lower base and upper support bar such that the upper support bar is pivotable between an open position in which the upper support bar extends upwardly generally perpendicular to the lower base, and a closed position in which the upper support bar is generally parallel to and in proximity to the lower base.

13. The golf training device of claim 11, wherein the target is cylindrical in shape and has a diameter of approximately two inches to three inches.

14. The golf training device of claim 13, wherein the target has a diameter of approximately 2.6 inches.

* * * * *